US010781078B2

(12) United States Patent
Reese

(10) Patent No.: US 10,781,078 B2
(45) Date of Patent: Sep. 22, 2020

(54) ELEVATOR TRACK CLEANER

(71) Applicant: Eddie Reese, Lincoln, GA (US)

(72) Inventor: Eddie Reese, Lincoln, GA (US)

( * ) Notice: Subject to any disclaimer, the term of this patent is extended or adjusted under 35 U.S.C. 154(b) by 32 days.

(21) Appl. No.: 16/268,058

(22) Filed: Feb. 5, 2019

(65) Prior Publication Data

US 2019/0247892 A1 Aug. 15, 2019

Related U.S. Application Data

(60) Provisional application No. 62/628,841, filed on Feb. 9, 2018.

(51) Int. Cl.

| | |
|---|---|
| ***B66B 7/12*** | (2006.01) |
| ***B08B 1/00*** | (2006.01) |
| ***A47L 13/04*** | (2006.01) |
| ***A46B 9/02*** | (2006.01) |
| ***A47L 13/06*** | (2006.01) |
| ***A47L 13/46*** | (2006.01) |
| ***A47L 13/12*** | (2006.01) |
| ***A47L 13/44*** | (2006.01) |
| ***A46B 9/00*** | (2006.01) |
| ***A46B 15/00*** | (2006.01) |

(52) U.S. Cl.

CPC ..... *B66B 7/1292* (2013.01); *A46B 9/005* (2013.01); *A46B 9/02* (2013.01); *A46B 15/0055* (2013.01); *A47L 13/04* (2013.01); *A47L 13/06* (2013.01); *A47L 13/12* (2013.01); *A47L 13/44* (2013.01); *A47L 13/46* (2013.01); *B08B 1/002* (2013.01); *B08B 1/006* (2013.01); *B66B 7/1276* (2013.01); *A46B 2200/3073* (2013.01); *A46B 2200/3093* (2013.01)

(58) Field of Classification Search

CPC ..... B66B 7/12; B66B 7/1276; B66B 7/1292; B08B 1/00; B08B 1/001; B08B 1/002; B08B 1/006; A46B 9/00; A46B 9/02; A46B 9/005; A46B 15/00; A46B 15/0055; A46B 2200/30; A46B 2200/3073; A46B 2200/3093; A47L 13/04; A47L 13/06; A47L 13/08; A47L 13/12; A47L 13/44; A47L 13/46

USPC ..... 15/114, 115, 160, 210.1, 229.11, 229.13, 15/231, 232, 247

See application file for complete search history.

(56) References Cited

U.S. PATENT DOCUMENTS 3,054,132 A * 9/1962 Ormerod ..... A47L 13/22 401/24
3,295,155 A * 1/1967 Belsky ..... A47L 13/254 15/147.2

(Continued)

FOREIGN PATENT DOCUMENTS

JP 10-94763 * 4/1998

*Primary Examiner* — Mark Spisich
(74) *Attorney, Agent, or Firm* — Patent Yogi LLC; Dhiraj Jindal

(57) ABSTRACT

The invention is directed to an elevator track cleaner. The track cleaner is provided in a rectangular scrub brush configuration, providing a platform with a raised handle affixed to the top surface. The bottom surface provides a longitudinal band of stiff, flexible bristles along the center-line, and two longitudinal bands of small hooks on either side of the bristles for the purpose of securing a flexible white scrub pad. The pad is used to scrub the elevator track, with the bristles urging the pad into the groove where the track is located.

6 Claims, 7 Drawing Sheets

(56) References Cited

U.S. PATENT DOCUMENTS

| | | | | |
|---|---|---|---|---|
| 5,522,110 | A * | 6/1996 | Borofsky | A47L 13/12 15/115 |
| 2013/0104327 | A1 * | 5/2013 | Borofsky | A47L 13/12 15/115 |

* cited by examiner

ELEVATOR TRACK CLEANER

RELATED APPLICATION(S)

Under provisions of 35 U.S.C. § 119e, the Applicant(s) claim the benefit of U.S. provisional application No. 62/628,841 filed Feb. 9, 2018, which is incorporated herein by reference.

FIELD OF THE INVENTION

The present invention relates generally to commercial cleaning tools and accessories, and in particular to an elevator track cleaner.

BACKGROUND OF THE INVENTION

In any building with an elevator, there is usually no metal surface that is exposed to more dirt and grime than an elevator track. Cleaning the elevator track is often very tiring for the worker, and requires expensive brushes manufactured from a steel alloy known as "tiger claw" steel.

A search of the prior art reveals various devices which have been developed to address this set of problems, or related problems. None are closely related to the present invention, but several include features which resemble those of the present invention. Each has proven to be less than satisfactory for the present purpose in its own way.

The U.S. Pat. No. 1,942,590 (priority Oct. 29, 1931), titled "Elevator cleaning device" provides a brush indicated in its entirety which is attached to a chain and which travels with said chain through two legs and about two sprockets. This brush includes a body constructed of wood or some other suitable material of uniform thickness. The body is rectangular in form being provided with a front edge, a rear edge and side edges, the surfaces of which extend parallel with the inner surfaces of the front, back and sides of the elevator legs proper, and which when the brush is attached to the chain are equally spaced from said surfaces. For the purpose of attaching the brush to the elevator chain, one of the buckets thereof is removed and the special link of said chain to which the bucket was previously attached utilized for this purpose. The body has attached to it a clip angle, one leg of which is bolted to the said body through bolts and the other leg of which extends outwardly from the brush body and is adapted to be bolted to the special link through bolts.

Further, U.S. Pat. No. 4,216,846 (priority Sep. 10, 1976), titled "Elevator rail cleaning system" provides an apparatus for continuously cleaning rust and other corrosion from elevator guide rails and for filling pits, joints and other irregular areas in the rails. A plurality of guide brackets is mounted on the car for contact with the rail. Each guide bracket includes a bushing insert for contact with surfaces of the guide rail. In one embodiment, the insert is made from an elastomeric material with particles of bronze or brass embedded therein. In a second embodiment, the insert has lead embedded therein. Where the insert has bronze or brass embedded therein, the sliding of the insert relative to the walls of the guide rails acts as an abrasive cleaner to remove rust, corrosion and dirt particles from the surface of the rails. Where the insert has lead embedded therein, contact between the insert and the rail results in the transfer of lead to the rails to fill pits, joint areas and irregularities in the rails. The inserts are formed with a plurality of ribs in which some are inclined upwardly while others are inclined downwardly from the longitudinal axis of the rail. Corrosion and rust scoured from the rail are channeled by the ribs and intermediate troughs away from the operating surface of the rails. Brush units are attached to the elevator car on opposite sides of each rail for contact with the rails. A cleaning solution is supplied to the brush units to provide further cleaning of the rails during operation of the elevator.

Further, U.S. Pat. No. 3,905,452 (priority Nov. 20, 1973), titled "Elevator system with guide rail cleaning devices" provides an elevator system including an elevator car mounted for guided movement via guide rails in the hoistway of a building to serve the floors therein. The guide rails are cleaned by a mechanism detachably mounted to the elevator car which includes a plurality of cleaning devices biased against predetermined surfaces of a guide rail. Movement of the elevator car provides relative movement between the cleaning devices and the guide rail resulting in cleaning of the guide rail.

Accordingly, there is a need for an improved cleaning device for elevator tracks that may also overcome one or more of the abovementioned problems and/or limitations.

SUMMARY OF THE INVENTION

This summary is provided to introduce a selection of concepts in a simplified form that are further described below in the Detailed Description. This summary is not intended to identify key features or essential features of the claimed subject matter. Nor is this summary intended to be used to limit the claimed subject matter's scope.

Accordingly, the present disclosure provides an elevator track cleaner. The track cleaner is provided in a rectangular scrub brush configuration. The track cleaner includes a platform with a raised handle affixed to a top surface of the platform. The bottom surface of the platform includes a longitudinal band of stiff, flexible bristles along the centerline, and two longitudinal bands of small hooks on either side of the bristles for the purpose of securing a flexible white scrub pad. The scrub pad may be used to scrub the elevator track, with the bristles urging the pad into the groove where the track is located.

If time can be spared for more frequent, light cleaning of an elevator track, it becomes much less difficult and expensive, while maintaining a bright metal shine on a day to day basis. The disclosed track cleaner is designed to accommodate this cleaning strategy on a narrow metal surface. The elevator track cleaner may be used for light, frequent cleaning.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
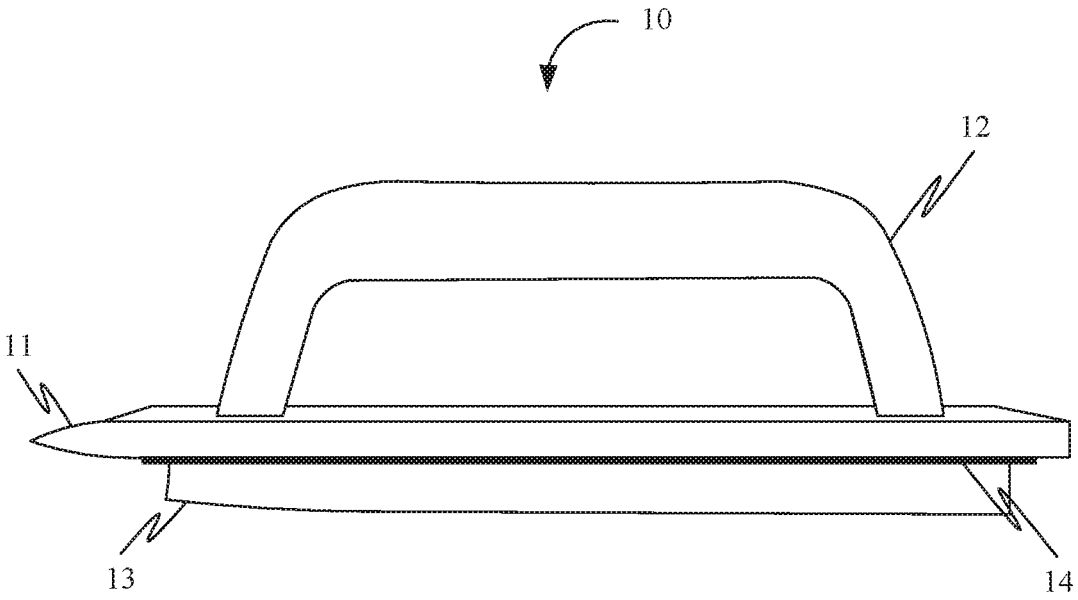
FIG. 1 is a side view a track cleaner, in accordance with a first exemplary embodiment.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

The present disclosure includes many aspects and features. Moreover, while many aspects and features relate to, and are described in, the context of cleaning devices for elevator tracks, embodiments of the present disclosure are not limited to use only in this context.

Figure 2:
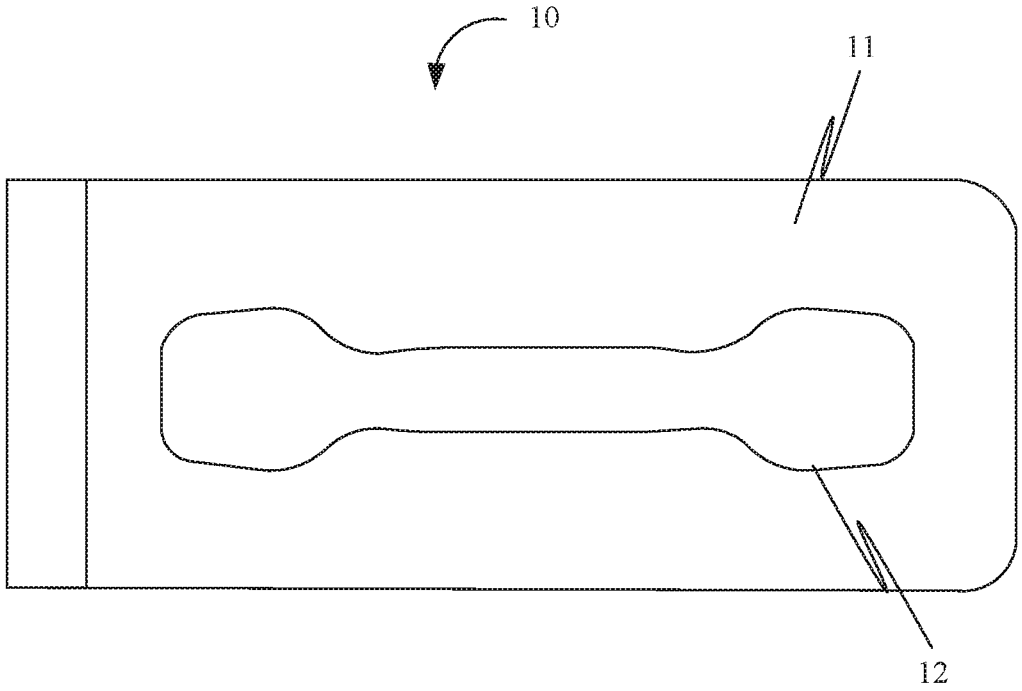
FIG. 2 is a top view of the track cleaner of FIG. 1.
Figure 3:
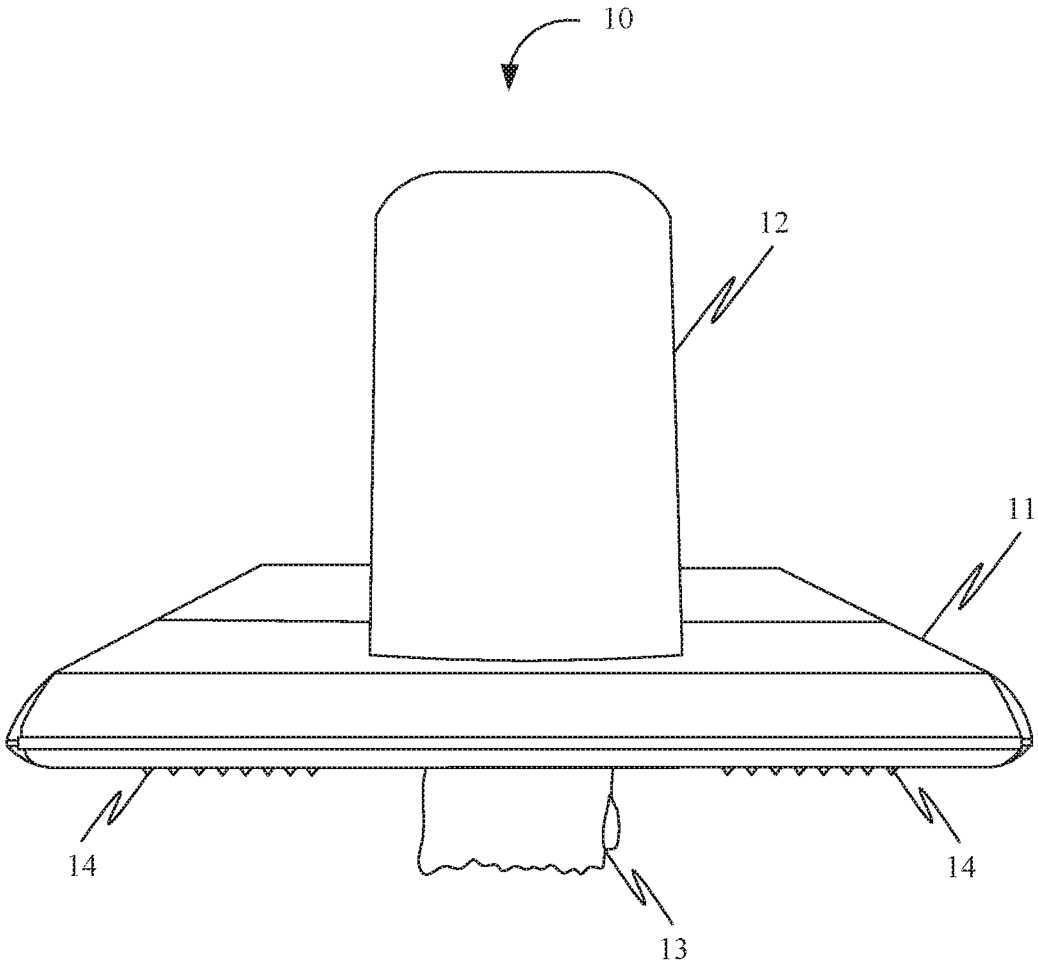
FIG. 3 is a front view of the track cleaner of FIG. 1.
Figure 4:
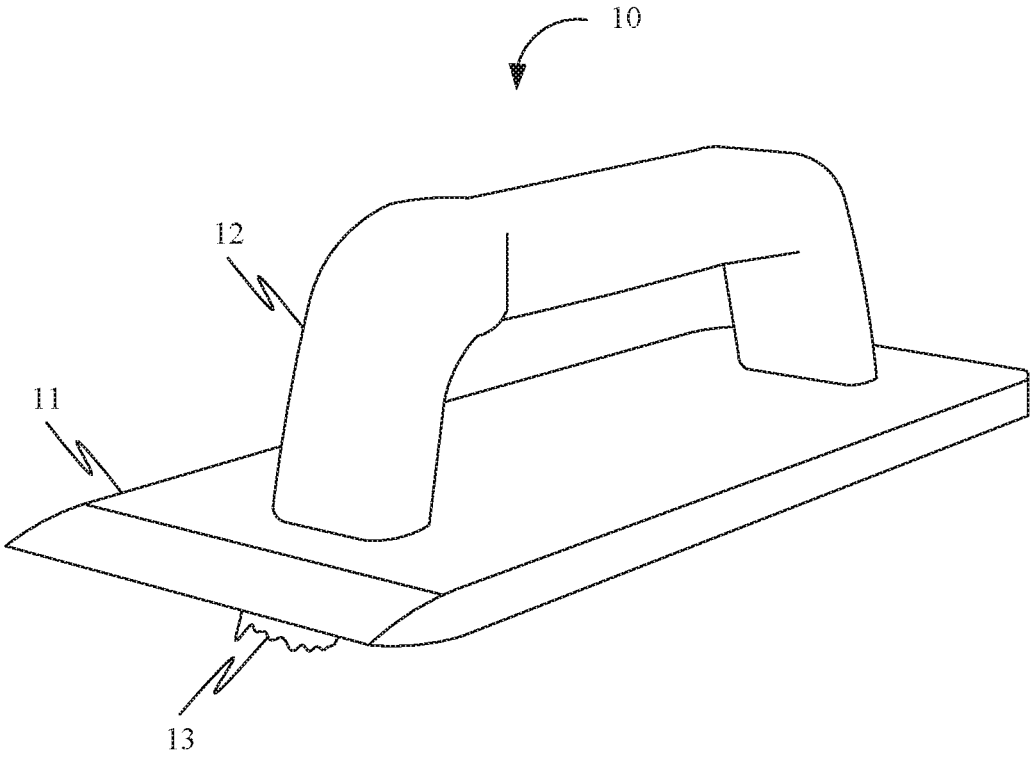
FIG. 4 is a front perspective view of the track cleaner of FIG. 1.
Figure 5:
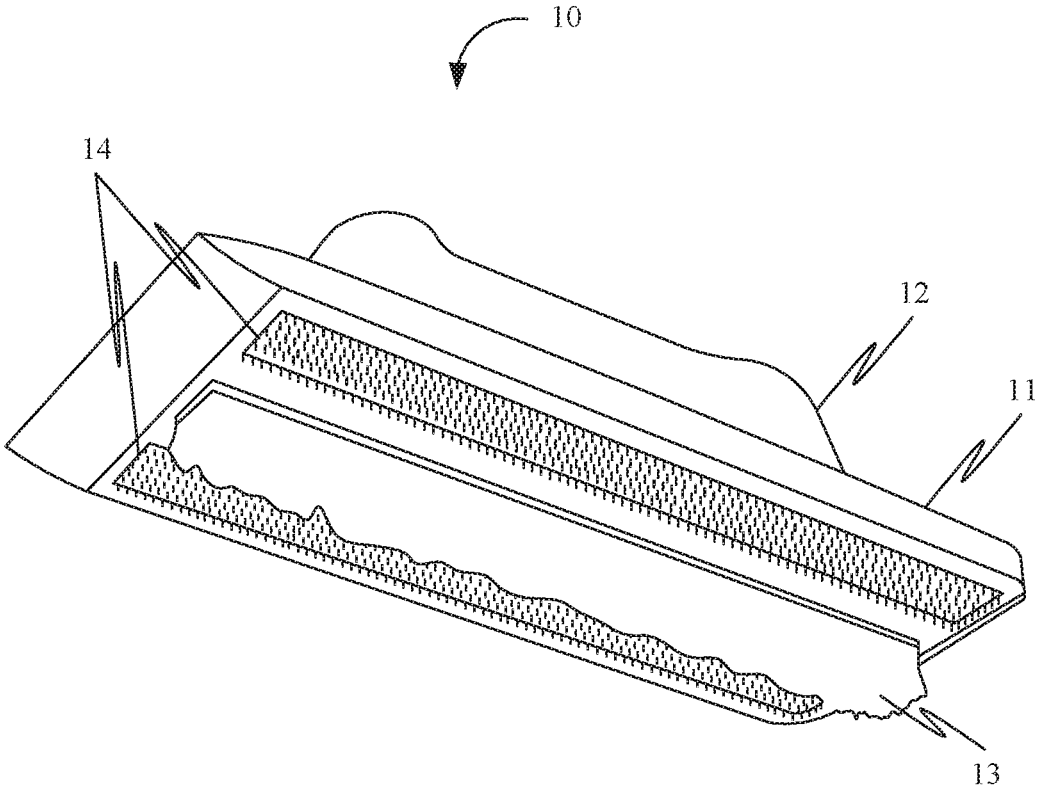
FIG. 5 is a bottom perspective view of the track cleaner of FIG. 1.

FIG. 1 is a side view a track cleaner 10, in accordance with a first exemplary embodiment. The track cleaner 10 includes a platform 11, a handle 12, bristles 13, and hooks 14. FIG. 2 is a top view of the track cleaner 10. FIG. 3 is a front view of the track cleaner 10. FIG. 4 is a front perspective view of the track cleaner 10. FIG. 5 is a bottom perspective view of the track cleaner 10.

Figure 6:
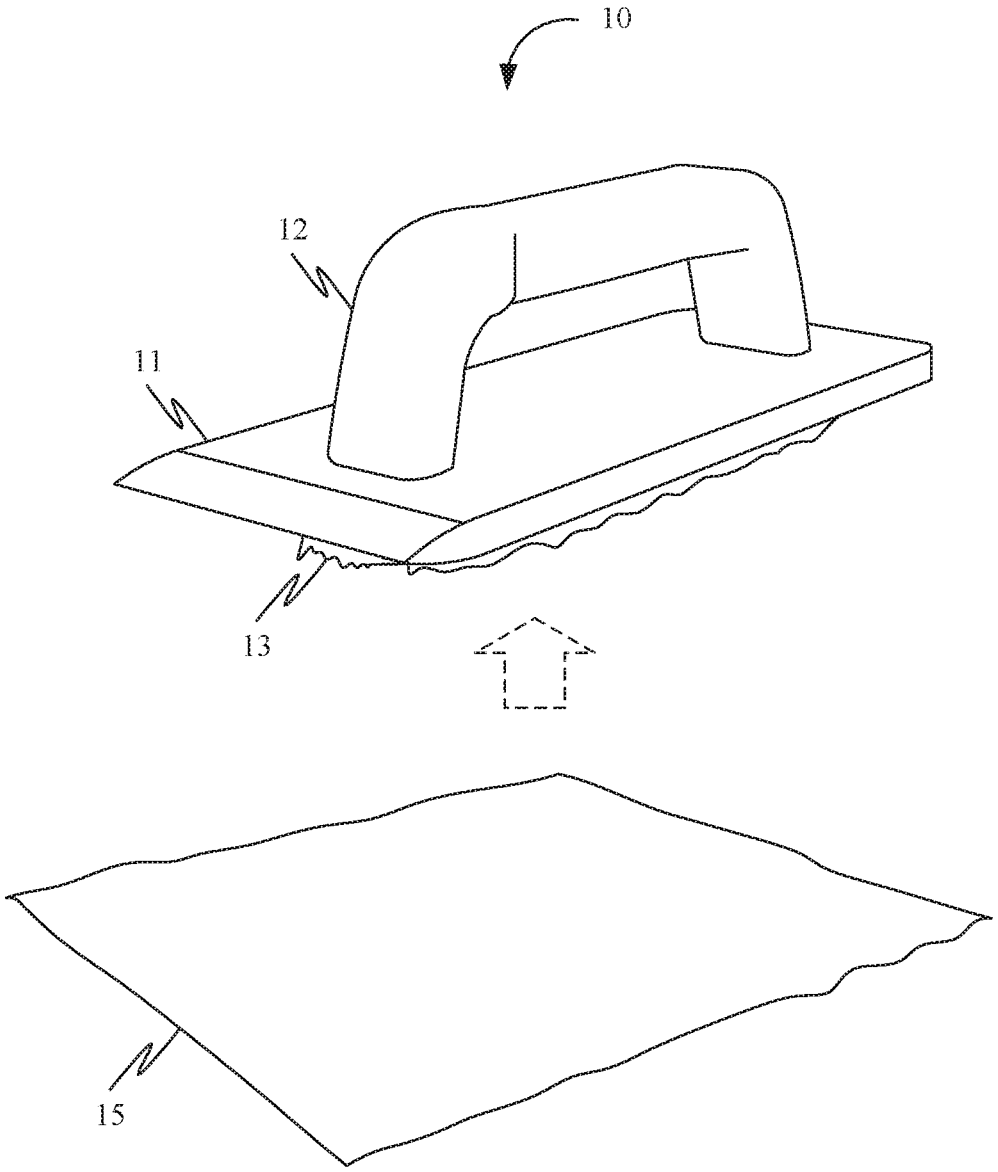
FIG. 6 is a front perspective view of the track cleaner of FIG. 1.
Figure 7:
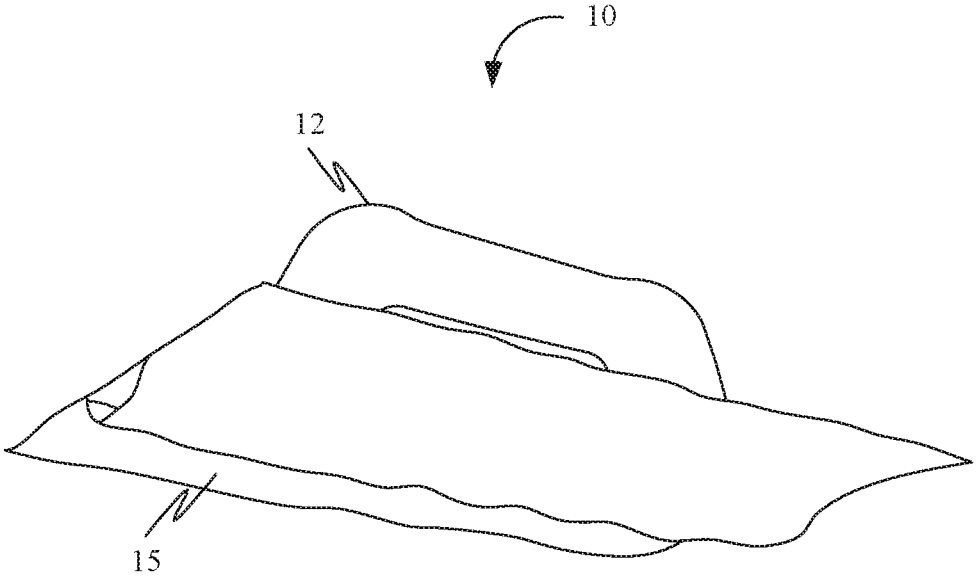
FIG. 7 is a bottom perspective view of the track cleaner of FIG. 1.

FIG. 6 is a front perspective view of the track cleaner 10 with a scrub pad 15 affixed. FIG. 7 is a bottom perspective view of the track cleaner 10.

According to a first exemplary embodiment, the track cleaner 10 is provided in a rectangular scrub brush configuration. In alternate embodiments, the track cleaner 10 may be provide in one of a circular configuration, an oval configuration, a square configuration.

Further, the track cleaner 10 includes the platform 11 with the raised handle 12 affixed to a top surface of the platform 11. A bottom surface of the platform 11 provides a longitudinal band of stiff, flexible bristles 13 along the centerline, and two longitudinal bands of small hooks 14 on either side of the bristles 13 for the purpose of securing the flexible white scrub pad 15. The scrub pad 15 is used to scrub the elevator track, with the bristles 13 urging the scrub pad 15 into the groove where the track is located.

Further, the replacement scrub pads 15 may be made available separately, and may be packaged in small packages, such as five scrub pads may be included in each package.

In order to use the track cleaner 10, the user may affix the scrub pad 15 to the hooks 14 of the track cleaner 10, as shown in FIGS. 6-7. Then, the user may spray an elevator track with water which may be mixed with a cleaning solvent as desired by the user. The user may then move the track cleaner 10 forward and back until the track is clean. After cleaning the track, the user may wipe off the excess water from the track with a sponge or soft cloth.

Further, one or more of the platform 11 and the handle 12 may be manufactured from rigid, durable materials, such as plastic or hardwood. The bristles 13 and the scrub pads 15 may be manufactured from a semi-rigid, durable material, such as nylon or plastic. The hooks 14 may be manufactured from a rigid, durable material, such as steel or aluminum alloy. Components and methods listed above are preferable, but artisans will recognize that alternate components and methods could be selected without altering the scope of the invention.

Although the invention has been explained in relation to its preferred embodiment, it is to be understood that many other possible modifications and variations can be made without departing from the spirit and scope of the invention.

What is claimed is:

1. An elevator track cleaner comprising:

an elongate generally rectangular platform having opposed top and bottom surfaces;

a handle provided on the top surface;

a band of bristles extending from the bottom surface of the platform, the band of bristles extending along a centerline of the length of the platform;

a pair of bands of hooks formed on the bottom surface on respective opposite sides of the band of bristles, the band of hooks extending along the length of the platform and that of the band of bristles;

a scrub pad having an area large enough to cover a substantial portion of the bottom surface of the platform; and when the scrub pad is attached to the hooks on the bottom surface of the platform the scrub pad covers a substantial portion of the bottom side of the platform including the band of bristles such that the bristles urge the pad into a groove of the elevator track.

2. The elevator track cleaner of claim 1, wherein the platform is manufactured from at least one of plastic and hardwood.

3. The elevator track cleaner of claim 1, wherein the handle is manufactured from at least one of plastic and hardwood.

4. The elevator track cleaner of claim 1, wherein the scrub pad is manufactured from at least one of nylon and plastic.

5. The elevator track cleaner of claim 1, wherein the band of bristles is manufactured from at least one of nylon and plastic.

6. The elevator track cleaner of claim 1, wherein the bands of hooks are manufactured from at least one of steel and aluminum alloy.

* * * * *